US005960754A

United States Patent [19]

Sugimoto et al.

[11] Patent Number: 5,960,754

[45] Date of Patent: Oct. 5, 1999

[54] VALVE OPERATING SYSTEM IN INTERNAL COMBUSTION ENGINE

[75] Inventors: Mitsuru Sugimoto; Shigekazu Saito; Kouichi Ikoma, all of Saitama, Japan

[73] Assignee: Honda Giken Kogyo Kabushiki Kaisha, Tokyo, Japan

[21] Appl. No.: 08/924,083

[22] Filed: Aug. 28, 1997

[30] Foreign Application Priority Data

Aug. 29, 1996 [JP] Japan ..... 8-228941

[51] Int. Cl.[6] ..... F01L 1/18; F01L 13/00

[52] U.S. Cl. ..... 123/90.15; 123/90.42

[58] Field of Search ..... 123/90.15, 90.16, 123/90.22, 90.39, 90.41, 90.42, 90.44, 90.5

[56] References Cited

U.S. PATENT DOCUMENTS

| | | | |
|---|---|---|---|
| 1,984,198 | 12/1934 | Notter | 123/90 |
| 4,848,285 | 7/1989 | Konno | 123/90.16 |
| 5,388,552 | 2/1995 | Sugimoto et al. | 123/90.16 |
| 5,460,130 | 10/1995 | Fukuzawa et al. | 123/90.16 |
| 5,515,820 | 5/1996 | Sugimoto et al. | 123/90.16 |
| 5,606,939 | 3/1997 | Spath | 123/90.5 |

FOREIGN PATENT DOCUMENTS

| | | |
|---|---|---|
| 0 607 918 A1 | 7/1994 | European Pat. Off. . |
| 43 37 952 A1 | 5/1995 | Germany . |
| 6-221125 | 8/1994 | Japan . |
| 7-8508 | 2/1995 | Japan . |

*Primary Examiner*—Weilun Lo
*Attorney, Agent, or Firm*—Lyon & Lyon LLP

[57] ABSTRACT

A valve operating system in an internal combustion engine including rollers which are in rolling contact with valve operating cams and rotatably supported by support shafts fixed to rocker arms in a manner such that the support shafts can be easily fixed to the rocker arms. In one embodiment, a rocker arm $\mathbf{25}_1$ is provided with a fitting bore 37 in which a support shaft $\mathbf{34}_1$ is fitted and with a press-fit bore 40 leading to an inner surface of the fitting bore 37. A locking groove 43 is provided in an outer surface of the support shaft $\mathbf{34}_1$ in correspondence to an opening of the press-fit bore 40 into the inner surface of the fitting bore 37, and extends in a direction tangent to a phantom circle $C_1$ about an axis of the support shaft $\mathbf{34}_1$. A pin 46 is press-fitted into the press-fit bore 40 and engaged in the locking groove 43.

6 Claims, 6 Drawing Sheets

VALVE OPERATING SYSTEM IN INTERNAL COMBUSTION ENGINE

FIELD OF THE INVENTION

The present invention relates to a valve operating system in an internal combustion engine, including rollers which are in rolling contact with valve operating cams and rotatably supported by support shafts fixed to rocker arms.

BACKGROUND OF THE INVENTION

Such a system is conventionally known, for example, from Japanese Patent Application Laid-open No.6-221125, Japanese Utility Model Application Laid-open No.7-8508 and the like.

In the above-identified known systems, to fix the support shafts to the rocker arms, the support shafts or the rocker arms are caulked or staked at a plurality of circumferential points at opposite ends of the support shafts. However, it is common that the support shafts and the rocker arms are subjected to a thermal treatment in order to increase the hardness thereof, and in carrying out the caulking or staking, it is necessary to partially remove the thermal treated portions from the support shafts or the rocker arms which have been subjected to the thermal treatment, resulting in a complicated operation for fixing the support shafts to the rocker arms, in cooperation with the fact that the caulking or staking must be carried out at the plurality of circumferential points.

The present invention has been accomplished with such circumstance in view, and it is an object of the present invention to provide a valve operating system in an internal combustion engine, wherein the support shafts can be easily fixed to the rocker arms.

SUMMARY OF THE INVENTION

To achieve the above object, according to one aspect of the present invention, there is provided a valve operating system in an internal combustion engine, comprising rollers which are in rolling contact with valve operating cams and rotatably supported by support shafts fixed to rocker arms, wherein the rocker arms are provided with fitting bores in which the support shafts are fitted and with press-fit bores leading to inner surfaces of the fitting bores, and the support shafts have locking grooves provided in outer surfaces thereof and extending in directions tangent to phantom circles about axes of the support shafts, with pins engaged in the locking grooves being press-fitted into the press-fit bores.

With such arrangement, the axial movement of the support shafts and the rotation of them about their axes are inhibited by the fact that the pins press-fitted into the press-fit bores in the rocker arms are inserted and engaged into the locking grooves in the support shafts fitted in the fitting bores. Therefore, as compared with support shafts that are fixed by the caulking, it is unnecessary to carry out the partial removal of the thermal treated portions, leading to a facilitated operation for fixing the support shafts.

According to another aspect of the present invention, in addition to the above features, an oil supply passage is provided within a rocker shaft which swingably carries the rocker arm, and a passage leading to the oil supply passage at the same diameter as and coaxially with the press-fit bore and the press-fit bore are provided in the rocker arm with the fitting bore interposed therebetween.

With such arrangement, it is possible to define the passage by drilling the press-fit bores through the fitting bores, thereby simultaneously making the passage for introducing an oil to outer surfaces of the support shafts and the press-fit bores.

According to still another aspect of the present invention, there is provided a valve operating system in an internal combustion engine, comprising rollers which are in rolling contact with valve operating cams and rotatably supported by support shafts fixed to rocker arms, wherein the rocker arms are provided with fitting bores in which the support shafts are fitted and with engage bores made to define limiting steps between the engage bores and one end of the fitting bores and eccentrically connected to one end of the fitting bores, and the system further includes eccentric protrusions provided at one end of said support shafts and fitted into the engage bores, and retaining rings mounted between the other end of the support shafts and the rocker arms for inhibiting the axial movement of the support shafts between the retaining rings and the limiting steps.

With such arrangement, the rotation of the support shafts about their axes is inhibited by the fact that the eccentric protrusions are fitted into the engage bores, and the axial movement of the support shafts is inhibited by the limiting steps and the retaining rings. Thus, as compared with the fixing of the support shafts using caulking, it is unnecessary to carry out the partial removal of the thermal treated portions, leading to a facilitated operation for fixing the support shafts.

DETAILED DESCRIPTION OF THE PREFERRED EMBODIMENTS

The mode for carrying out the present invention will now be described by way of preferred embodiments with reference to the accompanying drawings. In each of the embodiments, the type of valve operating system shown and described is capable of changing the timing and lift of the valves under different operating conditions but the invention is not necessarily limited to the details of such valve operating systems.

Figure 1:
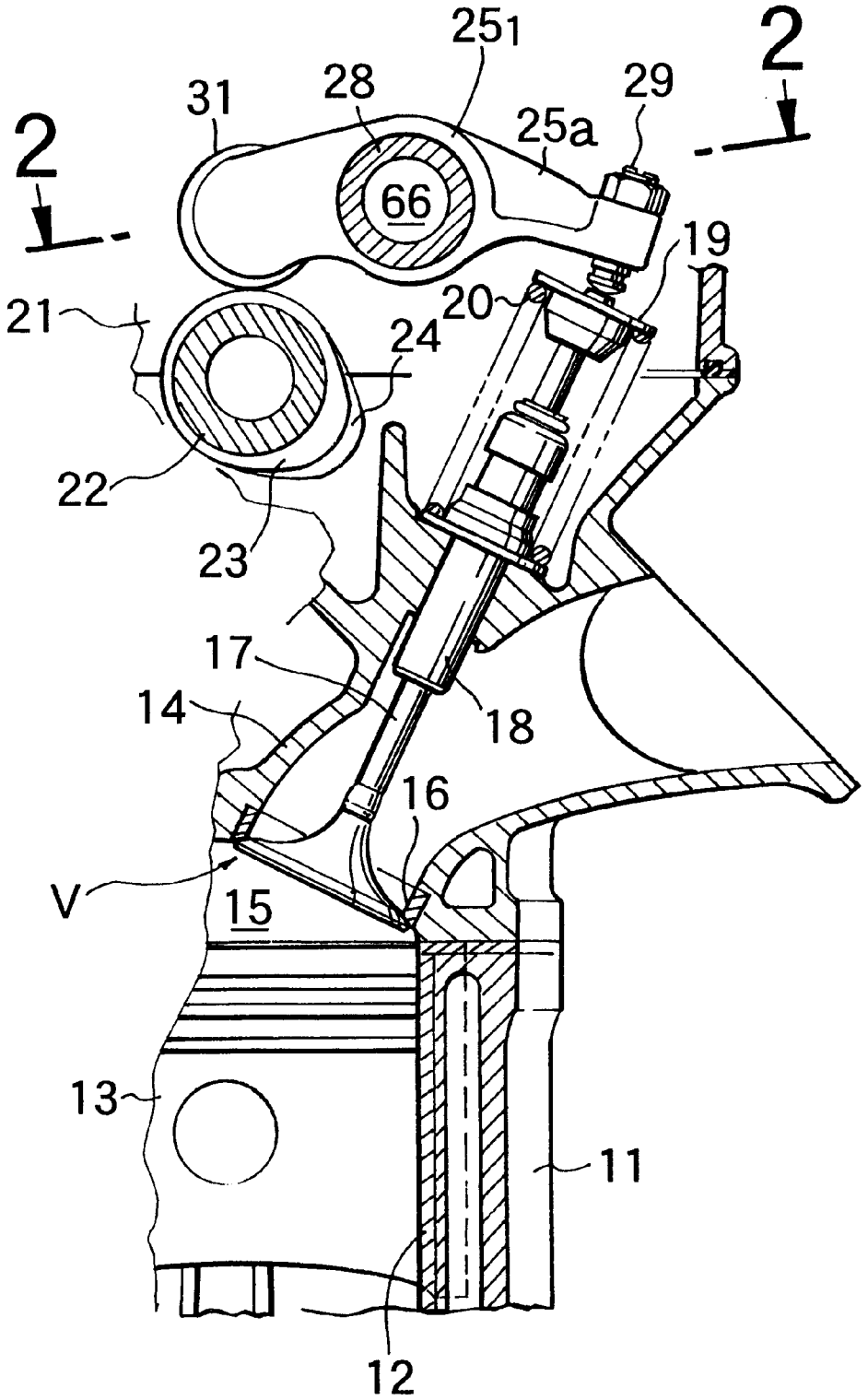
FIG. 1 is a vertical sectional view illustrating a portion of a valve operating system illustrating a first embodiment of the present invention.
Figure 2:
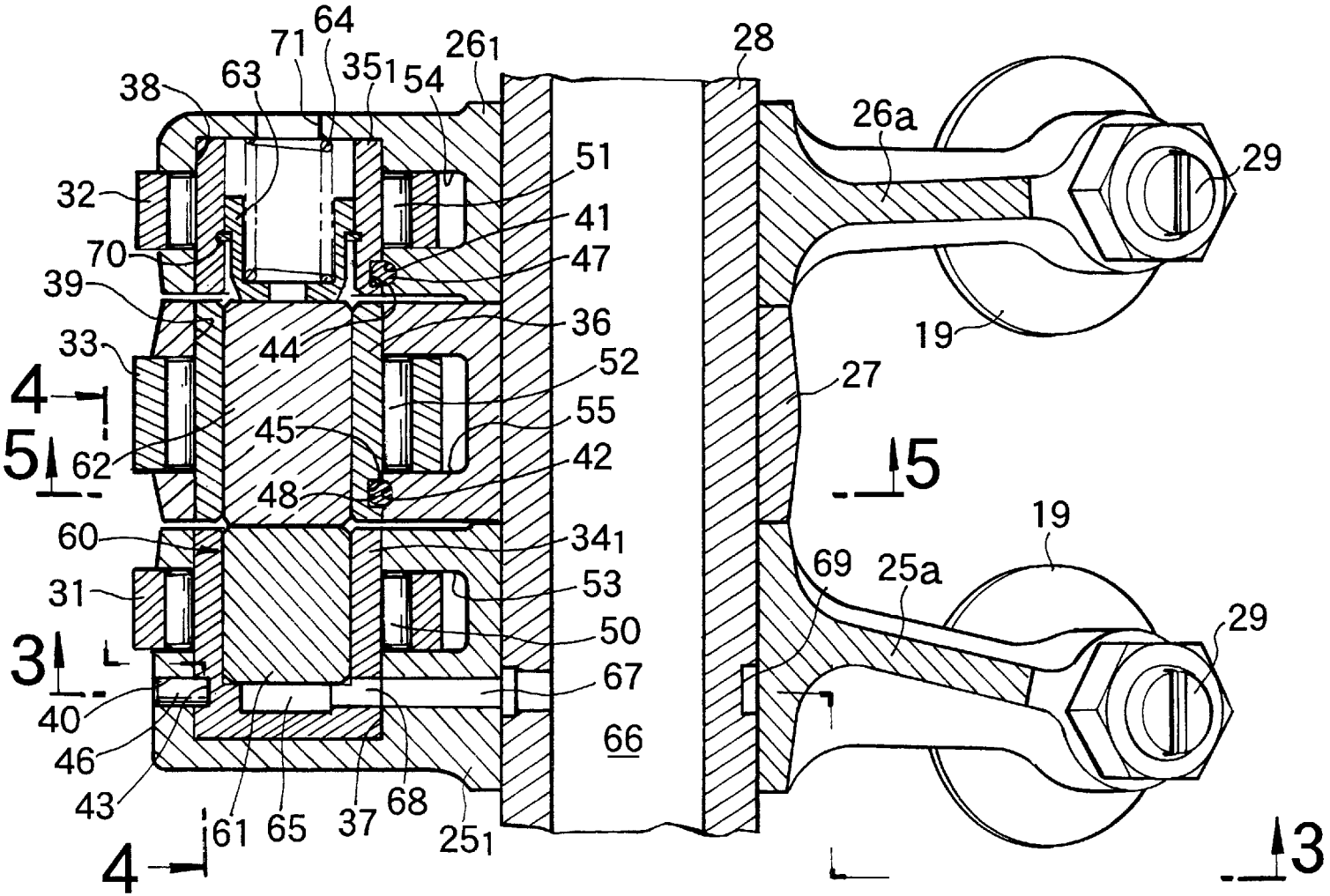
FIG. 2 is an enlarged sectional view taken along a line 2—2 in FIG. 1.
Figure 3:
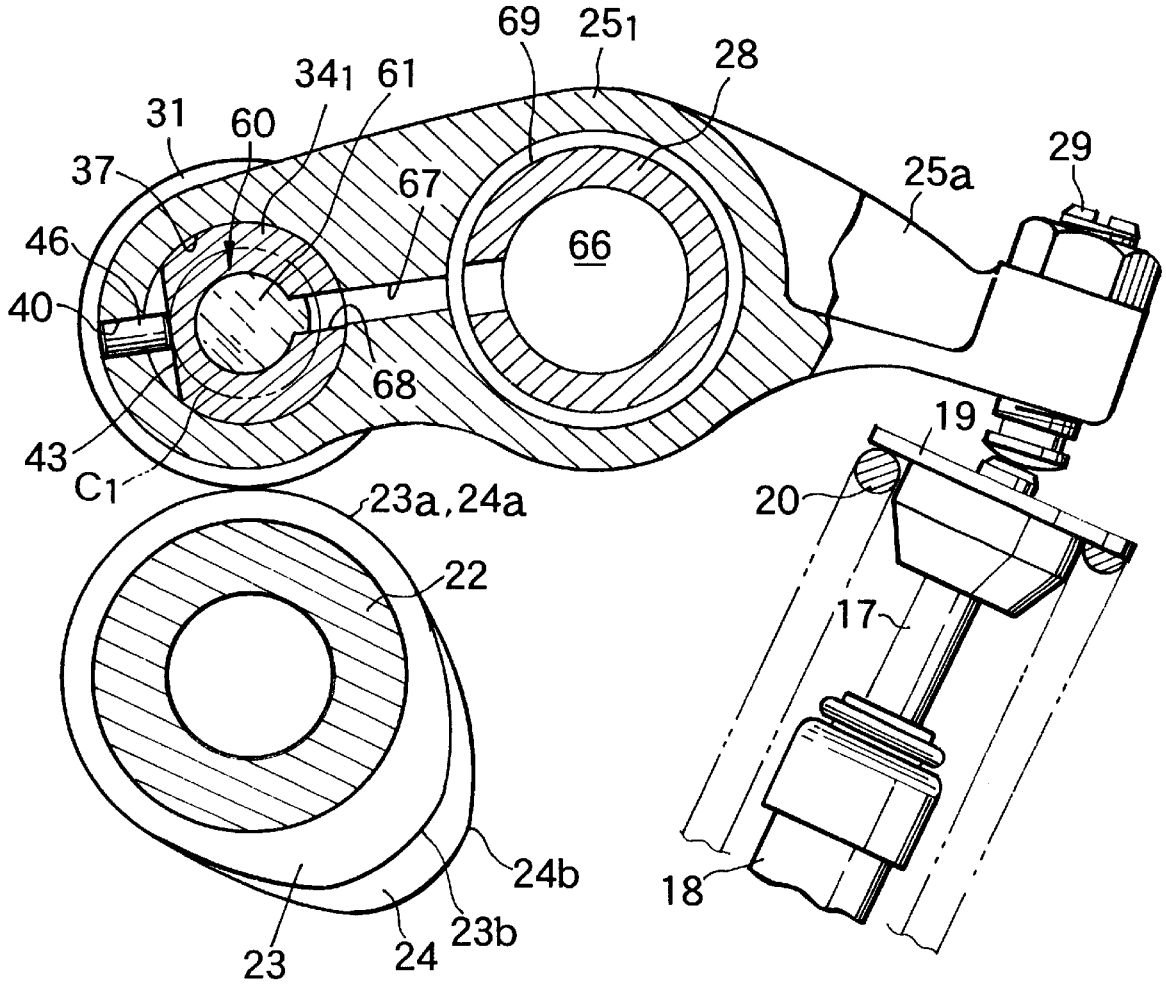
FIG. 3 is a sectional view taken along a line 3—3 in FIG. 2.
Figure 4:
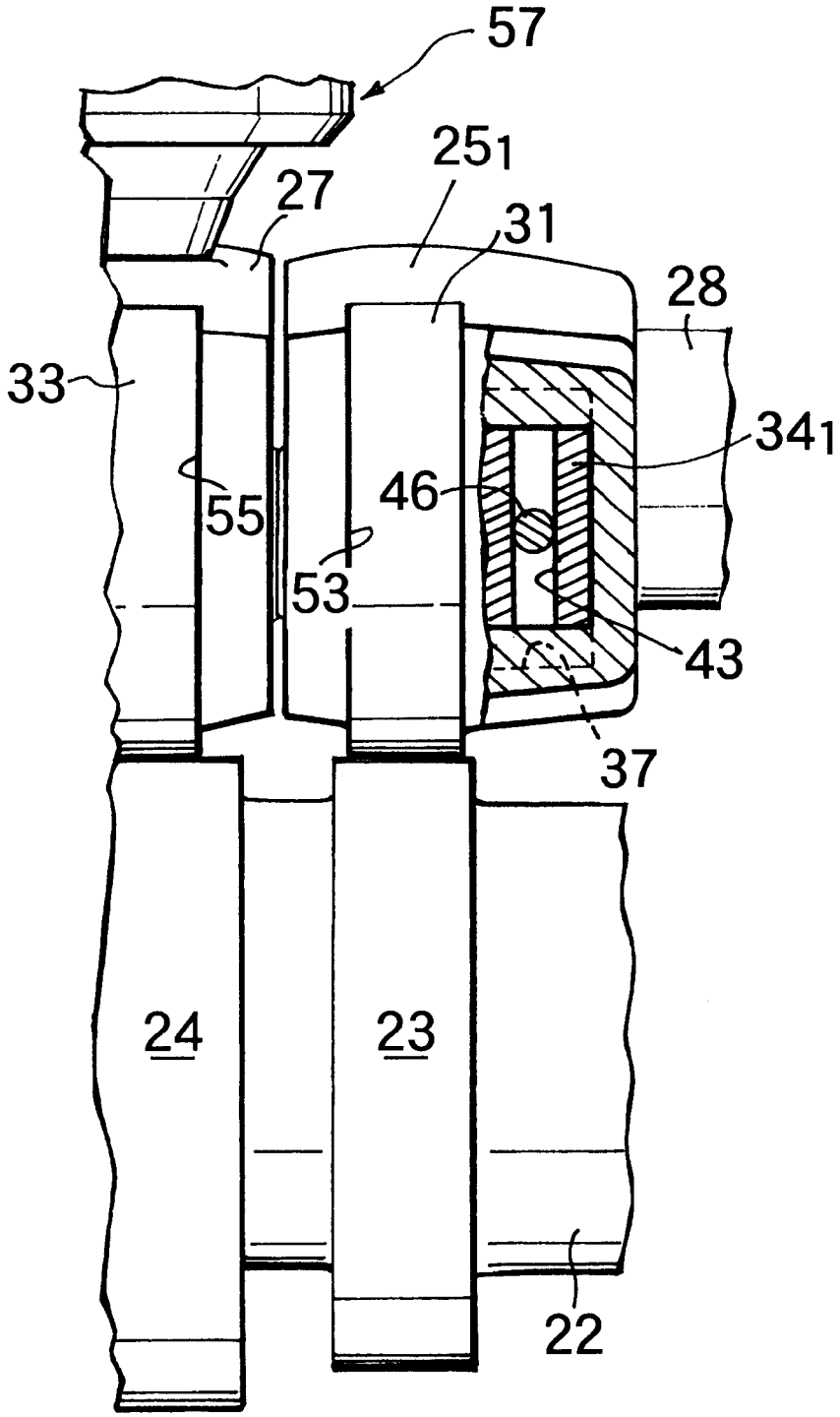
FIG. 4 is a sectional view taken along a line 4—4 in FIG. 2.

FIGS. 1 to 5 illustrate a first embodiment of the present invention. Referring first to FIG. 1, a piston 13 is slidably received in a cylinder 12 provided in a cylinder block 11 of an internal combustion engine, and a combustion chamber 15 is defined between an upper surface of the piston 13 and a cylinder head 14. A pair of intake valve bores 16 (only one being visible in FIG. 1) are provided in the cylinder head 14, so that they open into a ceiling surface of the combustion chamber 15. The intake valve bores 16 are opened and closed individually by intake valves V as engine valves whose stems 17 are slidably received in guide tubes 18 provided in the cylinder head 14. Valve springs 20 are mounted under compression between the cylinder head 14 and retainers 19 provided at upper ends of the stems 17 protruding upwards from the guide tubes 18, which springs 20 surround the stems 17, so that the intake valves V are biased in a direction to close the intake valve bores 16 under the action of the valve springs 20.

A cam shaft 22 parallel to an axis of a crankshaft (not shown) is rotatably supported by the cylinder head and a holder 21 coupled to the cylinder head 14. The cam shaft 22 is operatively connected to the crankshaft at a reduction ratio of ½.

Referring also to FIGS. 2 to 5, fixedly provided on the cam shaft 22 are a high-speed valve operating cam 24, and lower-speed valve operating cams 23 disposed on opposite sides of the high-speed valve operating cam 24 in correspondence to both the intake valves V respectively.

The high-speed valve operating cam 24 has a shape which permits both the intake valves V to be opened and closed in a high-speed operational range of the engine. The high-speed valve operating cam 24 includes a base circle-portion 24*a* which is arcuate about an axis of the cam shaft 22, and a cam lobe 24*b* protruding radially outwards from the base circle-portion 24*a*. The lower-speed valve operating cam 23 has a shape which permits the intake valves to be opened and closed in a low-speed operational range of the engine. The lower-speed valve operating cam 23 includes a base circle-portion 23*a* which is formed into an arcuate shape about the axis of the cam shaft 22, and a cam lobe 23*b* which protrudes radially outwards from the base circle-portion 23*a* in a protrusion amount smaller than the amount of cam lobe 24*b* protruding from the base circle-portion 24*a* in the high-speed valve operating cam 24 and in a region of a center angle smaller than that of the cam lobe 24*b*. The two cam lobes 23*b* may be the same or different, depending on the desired operating characteristics.

To convert the rotating movement of the cam shaft 22 into the opening and closing movements of the intake valves V, there are a first driving rocker arm $\mathbf{25}_1$ operatively connected to one of the intake valves V, a second driving rocker arm $\mathbf{26}_1$ operatively connected to the other intake valve V, and a free rocker arm 27 which can become free with respect to the intake valves V. These rocker arms are disposed adjacent one another in such a manner that the free rocker arm 27 is interposed between the first and second driving rocker arms $\mathbf{25}_1$ and $\mathbf{26}_1$. Each of the rocker arms $\mathbf{25}_1$, $\mathbf{26}_1$ and 27 is swingably carried on a rocker shaft 28 which has an axis parallel to the cam shaft 22 and which is fixedly supported on the holder 21 at a location lateral of and above the cam shaft 22.

The first and second driving rocker arms $\mathbf{25}_1$ and $\mathbf{26}_1$ are integrally provided with arms 25*a* and 26*a* extending toward the intake valves V, respectively. Tappet screws 29 are threadedly engaged with tip ends of the arms 25*a* and 26*a* for advancing and retreating movements to abut against upper ends of the stems 17 of the intake valves V, respectively.

A cylindrical roller 31 is rotatably carried at that end of the first driving rocker arm $\mathbf{25}_1$ which is opposite from the intake valve V with respect to the swinging axis of the first driving rocker arm $\mathbf{25}_1$, i.e., the axis of the rocker shaft 28, so that the roller 31 is in rolling contact with the low-speed valve operating cam 23. A cylindrical roller 32 is rotatably carried at that end of the second driving rocker arm $\mathbf{26}_1$ which is opposite from the intake valve V with respect to the swinging axis of the second driving rocker arm $\mathbf{26}_1$, so that the roller 32 is in rolling contact with the other low-speed valve operating cam 23. A cylindrical roller 33 is rotatably carried at that end of the free rocker arm 27 which is opposite from both the intake valves V with respect to the swinging axis of the free rocker arm 27, so that the roller 33 is in rolling contact with the high-speed valve operating cam 24.

A bottomed cylindrical support shaft $\mathbf{34}_1$ for rotatably carrying the roller 31 is fitted and fixed in the first driving rocker arm $\mathbf{25}_1$, and a cylindrical support shaft $\mathbf{35}_1$ for rotatably carrying the roller 32 is fitted and fixed in the second driving rocker arm $\mathbf{26}_1$. A cylindrical support shaft 36 for rotatably carrying the roller 33 is fitted and fixed in the free rocker arm 27. These support shafts $\mathbf{34}_1$, $\mathbf{35}_1$ and 36 are formed with the same inside diameter.

A bottomed fitting bore 37 is provided in the first driving rocker arm $\mathbf{25}_1$ in parallel to the rocker shaft 28, and opens toward the free rocker arm 27. A bottomed fitting bore 38 is provided in the second driving rocker arm $\mathbf{26}_1$ in parallel to the rocker shaft 28, and opens toward the free rocker arm 27. Further, a fitting bore 39 is provided in the free rocker arm 27 in parallel to the rocker shaft 28, and opens at its opposite ends in axial alignment with the bottomed fitting bores 37 and 38.

The support shaft $\mathbf{34}_1$ is fitted in the fitting bore 37 in the first driving rocker arm $\mathbf{25}_1$ in such a manner that one closed end thereof abuts against a closed end of the fitting bore 37. Moreover, a press-fit bore 40 is provided in the first driving rocker arm $\mathbf{25}_1$ and extends in a direction perpendicular to axes of the rocker shaft 28 and the fitting bore 37 between an outer surface of the first driving rocker arm $\mathbf{25}_1$ and an inner surface of the fitting bore 37. A locking groove 43 is provided in an outer surface of the support shaft $\mathbf{34}_1$ in correspondence to an opening of the press-fit bore 40 into the inner surface of the fitting bore 37 and extends in a direction tangent to a phantom circle $C_1$ (see FIG. 3) about the axis of the support shaft $\mathbf{34}_1$. A pin 46 is press-fitted into the press-fit bore 40 in such a manner that its end portion is inserted into and engaged into the locking groove 43. Thus, the support shaft $\mathbf{34}_1$ is fixed to the first driving rocker arm $\mathbf{25}_1$.

The support shaft 36 is fitted in the fitting bore 39 in the free rocker arm 27. A press-fit bore 42 is provided in the free rocker arm 27 and extends vertically in such a manner that its intermediate portion is in communication with the fitting bore 39. A locking groove 45 is provided in an outer surface of the support shaft 36 in correspondence to an opening of the press-fit bore 42 into an inner surface of the fitting bore 39, and extends in a direction tangent to a phantom circle $C_2$ (see FIG. 5) about the axis of the support shaft 36. A pin 48 is press-fitted into the press-fit bore 42 in such a manner that its intermediate portion is inserted and engaged into the locking groove 45. Thus, the support shaft 36 is fixed to the free rocker arm 27.

The support shaft $\mathbf{35}_1$ is fitted in the fitting bore 38 in the second driving rocker arm $\mathbf{26}_1$ and fixed to the second driving rocker arm $\mathbf{26}_1$ in a structure similar to the structure of fixing the support shaft 36 to the free rocker arm 27. More specifically, a pin 47 is press-fitted into the press-fit bore 41 provided in the second driving rocker arm $\mathbf{26}_1$ and engaged into a locking groove 44 provided in the outer surface of the support shaft $\mathbf{35}_1$ fitted in the fitting bore 38.

Needle bearings 50, 51 and 52 are interposed between the support shafts $\mathbf{34}_1$, $\mathbf{35}_1$ and 36 and the rollers 31, 32 and 33 concentrically surrounding the support shafts $\mathbf{34}_1$, $\mathbf{35}_1$ and 36, respectively. Large grooves 53, 54 and 55 are provided in the rocker arms $\mathbf{25}_1$, $\mathbf{26}_1$ and 27 to extend across the intermediate portions of the fitting bores 37, 38 and 39, respectively, forming a forked end on each rocker arm. The roller 31 and the needle bearing 50 are disposed in the groove 53; the roller 32 and the needle bearing 51 are disposed in the groove 54; and the roller 33 and the needle bearing 52 are disposed in the groove 55.

Figure 5:
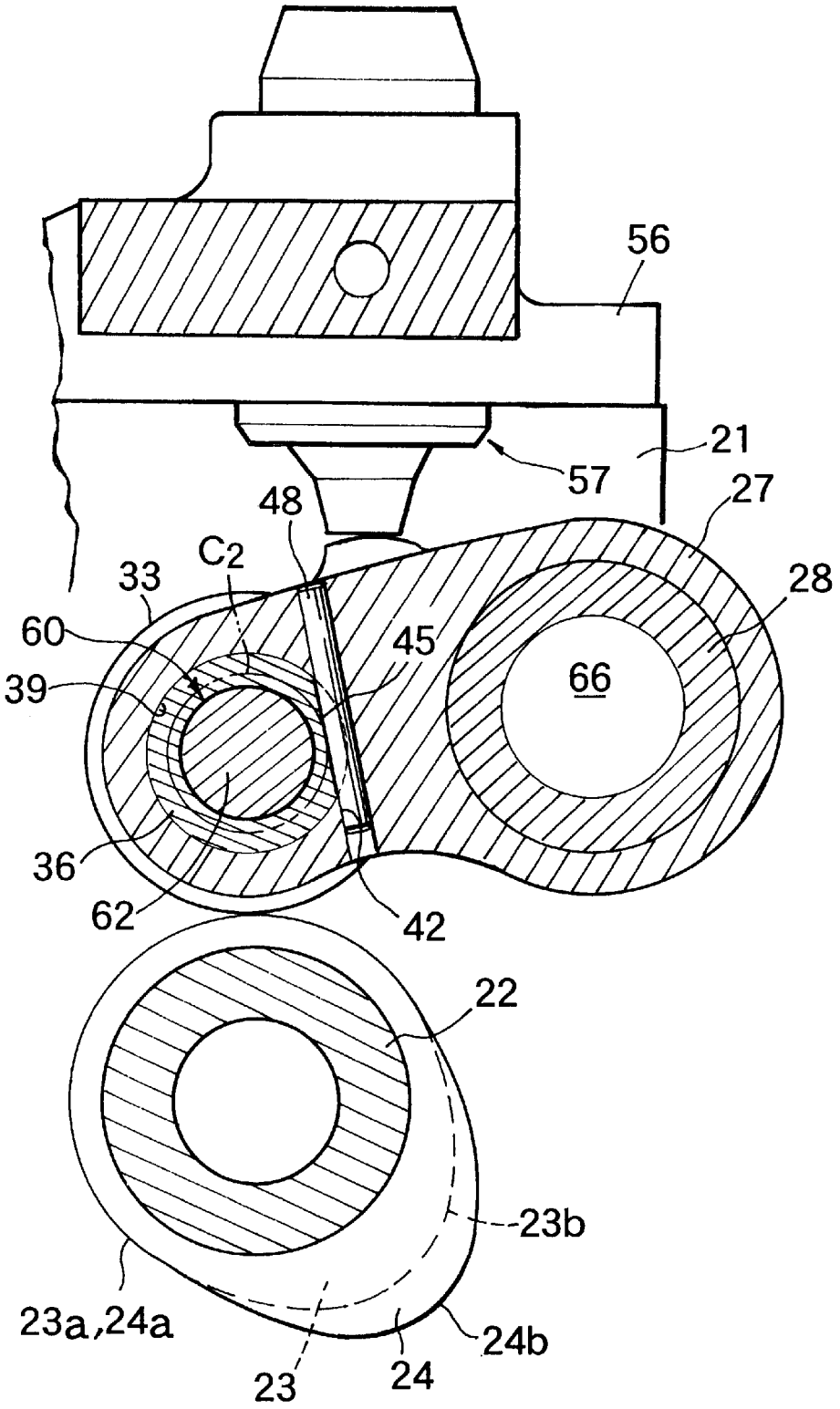
FIG. 5 is a sectional view taken along a line 5—5 in FIG. 2.

As shown in FIG. 5, a support plate 56 is fixed on the holder 21 above the rocker arms $\mathbf{25}_1$, $\mathbf{26}_1$ and 27, and a lost motion means 57 is provided on the support plate 56 for resiliently biasing the free rocker arm 27 in a direction to bring the roller 33 into rolling contact with the high-speed valve operating cam 24.

The rocker arms $\mathbf{25}_1$, $\mathbf{26}_1$ and 27 are provided with an interlocking operation switch-over mechanism 60 which is switched over between a state in which it permits the rocker arms $\mathbf{25}_1$, $\mathbf{26}_1$ and 27 to be individually swung and a state in which it requires the rocker arms $\mathbf{25}_1$, $\mathbf{26}_1$ and 27 to be swung in unison with one another, so that the operational characteristics of the intake valves V are changed depending upon the operational state of the engine. The interlocking operation switch-over mechanism 60 includes a first switch-over pin 61 capable of switching over the interlocking operation of the first driving rocker arm $\mathbf{25}_1$ and the free rocker arm 27 and the releasing of such interlocking operation from one to another, a second switch-over pin 62 capable of switching over the interlocking operation of the free rocker arm 27 and the second driving rocker arm $\mathbf{26}_1$ and the releasing of such interlocking operation from one to another, a bottomed cylindrical limiting member 63 which is in sliding contact with the second switch-over pin 62 on the opposite side from the first switch-over pin 61, and a return spring 64 for biasing the limiting member 63 toward the second switch-over pin 62.

The first switch-over pin 61 is slidably fitted in the support shaft $\mathbf{34}_1$ of the first driving rocker arm $\mathbf{25}_1$, and an hydraulic pressure chamber 65 is defined between one closed end of the support shaft $\mathbf{34}_1$ and the first switch-over pin 61. An oil supply passage 66 is provided within the rocker shaft 28 and connected to a fluid pressure source through a control valve which is not shown. A passage 67 is provided in the first driving rocker arm $\mathbf{25}_1$ and communicates at one end thereof with an annular groove 69 provided in the outer surface of the rocker shaft 28 so as to communicate with the oil supply passage 66. A communication bore 68 is provided in the support shaft $\mathbf{34}_1$ for permitting the passage 67 to be put into communication with the hydraulic pressure chamber 65.

The press-fit bore 40 and the passage 67 are defined at the same axial location and diameter, whereby they are coaxially provided in the first driving rocker arm $\mathbf{25}_1$ in such a manner that the fitting bore 37 is sandwiched therebetween.

The second switch-over pin 62 is slidably fitted in the support shaft 36 of the free rocker arm 27 and has one end which is in sliding contact with the first switch-over pin 61.

The limiting member 63 formed in a bottomed cylindrical shape is slidably fitted in the support shaft $\mathbf{35}_1$ of the second driving rocker arm $\mathbf{26}_1$, and has a closed end which is in sliding contact with the other end of the second switch-over pin 62. A retaining ring 70 is fitted to the inner surface of the support shaft $\mathbf{35}_1$ to abut against the limiting member 63 for inhibiting the falling-off of the limiting member 63 from the support shaft $\mathbf{35}_1$. The return spring 64 is mounted under compression between the closed end of the fitting bore 38 in the second driving rocker arm $\mathbf{26}_1$ and the limiting member 63, and an opening bore 71 is provided in the closed end of the fitting bore 38.

With such interlocking operation switch-over mechanism 60, in the low-speed operational range of the engine, no hydraulic pressure is applied to the hydraulic pressure chamber 65; the sliding contact surfaces of the first and second switch-over pins 61 and 62 are at positions which correspond to between the first driving rocker arm $\mathbf{25}_1$ and the free rocker arm 27; and the sliding contact surfaces of the second switch-over pin 62 and the limiting member 63 are at positions which correspond to between the free rocker arm 27 and the second driving rocker arm $\mathbf{26}_1$. Therefore, the rocker arms $\mathbf{25}_1$, $\mathbf{26}_1$ and 27 are in mutually independent swingable states, so that the intake valves V are opened and closed at a timing and in a lift amount determined by the low-speed valve operating cams 23.

In the high-speed operational range of the engine, a high hydraulic pressure is applied to the hydraulic pressure chamber 65; the first switch-over pin 61 is fitted into the support shaft 36 of the free rocker arm 27 while urging the second switch-over pin 62; and the second switch-over pin 62 is fitted into the support shaft $\mathbf{35}_1$ of the second driving rocker arm $\mathbf{26}_1$ while urging the limiting member 63. Therefore, the rocker arms $\mathbf{25}_1$, $\mathbf{26}_1$ and 27 are brought into integrally connected states, so that the intake valves V are opened and closed at a timing and in a lift amount determined by the high-speed valve operating cam 24.

The operation of the first embodiment will be described below. To fix the support shafts $\mathbf{34}_1$, $\mathbf{35}_1$ and 36 to the corresponding rocker arms $\mathbf{25}_1$, $\mathbf{26}_1$ and 27 in order to rotatably carry the rollers 31, 32 and 33 which are in rolling contact with the two low-speed valve operating cams 23 and the high-speed valve operating cam 24, respectively, the rocker arms $\mathbf{25}_1$, $\mathbf{26}_1$ and 27 are provided with the fitting bores 37, 38 and 39 in which the support shafts $\mathbf{34}_1$, $\mathbf{35}_1$ and 36 are fitted, and with press-fit bores 40, 41 and 42 leading to the inner surfaces of the fitting bores 37 to 39, respectively. In addition, the locking grooves 43, 44 and 45 are provided in the outer surfaces of the support shafts $\mathbf{34}_1$, $\mathbf{35}_1$ and 36 in correspondence to the openings of the press-fit bores 40 to 42 into the inner surfaces of the fitting bores 37 to 39, and the pins 46, 47 and 48 are press-fitted into the press-fit bores 40 to 42 and engage in the locking grooves 43 to 45. Moreover, the locking grooves 43 to 45 are defined to extend in the direction tangent to the phantom circles $C_1$ and $C_2$ about the axes of the support shafts $\mathbf{34}_1$, $\mathbf{35}_1$ and 36.

Therefore, the axial movements of the support shafts $\mathbf{34}_1$, $\mathbf{35}_1$ and 36 and the rotations of them about their axes are inhibited only by the engagement of the pins 46 to 48 into the locking grooves 43 to 45, respectively. In such a fixing structure, as compared with the conventional fixing structure using a caulking (or staking), it is unnecessary to carry out the step of partially removing treatment of the thermal treated portions and moreover, a caulking operation at a plurality of points is not required. Thus, even if the drilling of the press-fit bores 40 to 42 and the operation for press-fitting the pins 46 to 48 into the press-fit bores 40 to 42 are taken into consideration, the operation for fixing the support shafts $\mathbf{34}_1$, $\mathbf{35}_1$ and 36 is improved and facilitated.

The passage 67 provided in the first driving rocker arm $\mathbf{25}_1$ to lead to the oil supply passage 66 within the rocker shaft 28 acts to apply the hydraulic pressure to the hydraulic pressure chamber 65 in the inter locking operation switch-over mechanism 60 and also acts to supply the lubricating oil through the clearance between the support shaft $\mathbf{34}_1$ and the first driving rocker arm $\mathbf{25}_1$ toward the roller 31. However, the passage 67 and the press-fit bore 40 are formed of the same diameter and coaxially disposed with the fitting bore 37 interposed therebetween and hence, the passage 67 and the press-fit bore 40 can be simultaneously drilled, leading to a samples field drilling operation.

In the first embodiment, the dispositions of the pins 47 and 48 in the second driving rocker arm $\mathbf{26}_1$ and the free rocker arm 27 are different from the disposition of the pin 46 in the first driving rocker arm $\mathbf{25}_1$. Alternatively, of course, passages leading to the oil supply passage 66 within the rocker shaft 28 and the press-fit bores 41 and 42 into which the pins 47 and 48 for fixing the support shafts $\mathbf{35}_1$ and 36 are press-fitted, may be formed at the same axial location, the same diameter and coaxially, similar to passage 67 and bore 40, so that the lubricating oil may be introduced to the outer surfaces of the support shafts $\mathbf{35}_1$ and 36.

Figure 6:
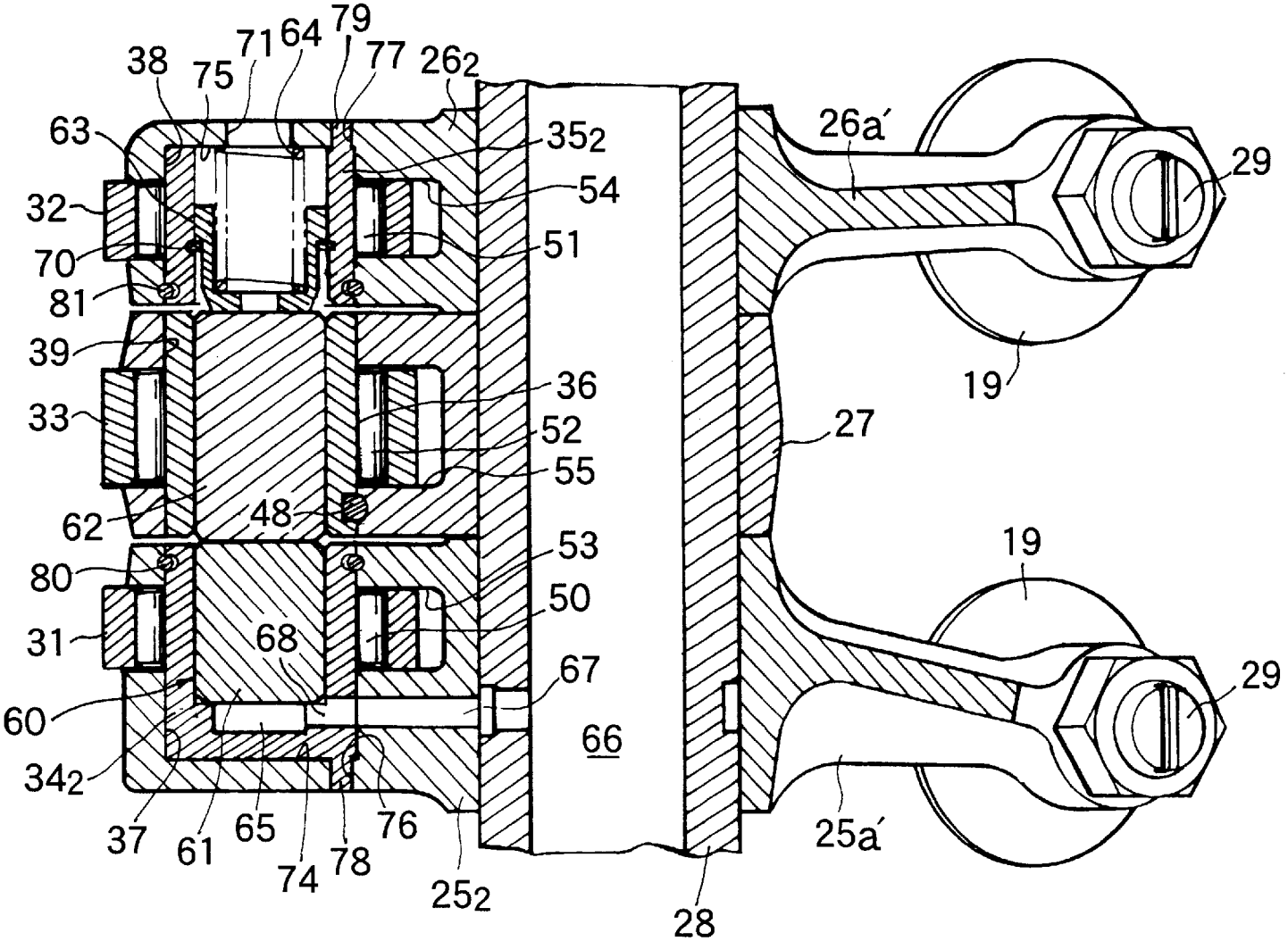
FIG. 6 is a sectional view similar to FIG. 2, but illustrating a second embodiment of the invention.

FIG. 6 illustrates a second embodiment of the present invention, wherein portions or components corresponding to those in the first embodiment are designated by like reference characters and some may not be described again in detail.

A first driving rocker arm $\mathbf{25}_2$, a second driving rocker arm $\mathbf{26}_2$ and a free rocker arm 27 are disposed adjacent one another in such a manner that the free rocker arm 27 is interposed between the first driving rocker arm $\mathbf{25}_2$, and the second driving rocker arm $\mathbf{26}_2$. The first and second driving rocker arms $\mathbf{25}_2$ and $\mathbf{26}_2$ are integrally provided with arms 25*a*' and 26*a*' in which tappet screws 29 are threadedly engaged for advancing and retreating movements to abut against the upper ends of the stems 17 of both the intake valves V.

A bottomed cylindrical support shaft $\mathbf{34}_2$ for rotatably carrying a roller 31 is fitted and fixed in the first driving rocker arm $\mathbf{25}_2$. A cylindrical support shaft $\mathbf{35}_2$ for rotatably carrying a roller 32 is fitted and fixed in the second driving rocker arm $\mathbf{26}_2$. A cylindrical support shaft 36 for rotatably carrying a roller 33 is fitted and fixed in the free rocker arm 27 by the same structure as in the first embodiment.

The support shaft $\mathbf{34}_2$ is fitted into a fitting bore 37 in the first driving rocker arm $\mathbf{25}_2$ in such a manner that one closed end thereof abuts against a closed end of the fitting bore 37. Moreover, an engage bore 76 is provided in the closed end of the fitting bore 37 to define a limiting step 74 between the engage bore 76 and one end of the fitting bore 37, so that it is eccentrically connected to the one end of the fitting bore 37. An eccentric protrusion 78 is provided at one end of the support shaft $\mathbf{34}_2$ and fitted into the engage bore 76, and a retaining ring 80 is mounted between the other end of the support shaft $\mathbf{34}_2$ and the first driving rocker arm $\mathbf{25}_2$ for inhibiting the axial movement of the support shaft $\mathbf{34}_2$ between the retaining ring 80 and the limiting step 74.

The support shaft $\mathbf{35}_2$ is fitted into the fitting bore 38 in the second driving rocker arm $\mathbf{26}_2$ in such a manner that one end thereof abuts against the closed end of the fitting bore 38. Moreover, an engage bore 77 is provided in the closed end of the fitting bore 38 to define a limiting step 75 between the engage bore 77 and one end of the fitting bore 38, so that it is eccentrically connected to the one end of the fitting bore 38, and an eccentric protrusion 79 is provided at one end of the support shaft $\mathbf{35}_2$ and fitted into the engage bore 77. A retaining ring 81 is mounted between the other end of the support shaft $\mathbf{35}_2$, and the second driving rocker arm $\mathbf{26}_2$ for inhibiting the axial movement of the support shaft $\mathbf{35}_2$ between the retaining ring 81 and the limiting step 75.

With the second embodiment, by the fact that the eccentric protrusions 78 and 79 are fitted into the engage bores 76 and 77, respectively, the rotation of the support shafts $\mathbf{34}_2$ and $\mathbf{35}_2$ about axes thereof is inhibited, and the axial movement of the support shafts $\mathbf{34}_2$ and $\mathbf{35}_2$ is inhibited by the limiting steps 74 and 75 and the retaining rings 80 and 81. Therefore, as compared with the conventional fixing structure using the caulking, it is unnecessary to carry out the step of partially removing treatment of the thermal treated portions and moreover, the caulking operation at a plurality of points is not required, leading to an improved and facilitated operation for fixing the support shafts $\mathbf{34}_2$ and $\mathbf{35}_2$.

Although the embodiments of the present invention have been described in detail, it will be understood that the present invention is not limited to the above-described embodiments, and various modifications in design may be made without departing from the spirit and scope of the invention defined in the claims.

For example, the interlocking operation switch-over mechanism 60 is disposed within the support shafts $\mathbf{34}_1$, $\mathbf{35}_1$ and 36, or $\mathbf{34}_2$, $\mathbf{35}_2$ and 36 in each of the embodiments, but the interlocking operation switch-over mechanism 60 may be positioned elsewhere on the rocker arms whereby the rollers are simply supported by support shafts. In this case, each of the support shafts may be formed into a solid column-like configuration. The present invention is also applicable to exhaust valves in the internal combustion engine.

As discussed above, according to one aspect of the present invention, by inserting and engaging the pins press-fitted in the press-fit bores into the locking grooves in the support shafts fitted in the fitting bores, the axial movements of and the rotation of the support shafts about the axes can be inhibited, leading to a facilitated operation for fixing support shafts.

According to another aspect of the present invention, the passage can be defined by drilling the press-fit bores through the fitting bores and thus, the passage for introducing the oil to the outer surfaces of the support shafts and the press-fit bores can be simultaneously defined, leading to a simplified drilling operation.

According to still another aspect of the invention, the rotation of the support shafts about their axes can be inhibited by the fitting of the eccentric protrusions in the engage bores, and the axial movements of the support shafts can be inhibited by the limiting steps and the retaining rings, leading to a facilitated operation for fixing the support shafts.

What is claimed:

1. A valve operating system in an internal combustion engine, comprising rollers which are in rolling contact with respective valve operating cams and rotatably supported by respective support shafts fixed to respective rocker arms, wherein said rocker arms are provided with fitting bores in which said support shafts are fitted and press-fit bores leading from an outer surface of said respective rocker arms to inner surfaces of said fitting bores, and said support shafts have locking grooves provided in outer surfaces thereof and extending in directions tangent to phantom circles about axes of said support shafts, with pins being press-fitted into said press-fit bores and engaging said locking grooves.

2. A valve operating system in an internal combustion engine according to claim 1, further including an oil supply passage provided within a rocker shaft which swingably carries said rocker arms, and a passage leading to said oil supply passage at the same diameter as and coaxially with one of said press-fit bores, said passages and said one press-fit bore being provided in one of said rocker arms with one of the fitting bores interposed therebetween.

3. A valve operating system in an internal combustion engine, comprising a rocker arm having a fitting bore, a support shaft mounted in said fitting bore, a roller rotatably supported by said support shaft for rolling contact with a valve operating cam, and said rocker arm and said support shaft having cooperating shapes and a removable locking element positioned between said rocker arm and said support shaft for fixing said support shaft to said rocker arm and preventing relative rotation and axial movement therebetween, said cooperating shapes include a press-fit bore in said rocker arm and a locking groove in said support shaft, and said removable locking element is a pin press-fitted into said press-fit bore and engaging said locking groove.

4. A valve operating system in an internal combustion engine, comprising a rocker arm having a fitting bore, a support shaft mounted in said fitting bore, a roller rotatably supported by said support shaft for rolling contact with a valve operating cam, a press-fit bore in said rocker arm leading from an outer surface of said rocker arm to an inner surface of said fitting bore, said support shaft having a locking groove provided in an outer surface thereof, and a pin press-fitted into said press-fit bore and engaging said locking groove.

5. A valve operating system according to claim 4, wherein said locking groove comprises a lateral and non-annular groove in said support shaft.

6. A valve operating system according to claim 4, further including an oil supply passage provided within a rocker shaft which swingably carries said rocker arm, and a passage leading to said oil supply passage at the same axial location and diameter as and coaxially with said press-fit bore, said passage and said press-fit bore being provided in said rocker arm with said fitting bore interposed therebetween.

* * * * *